United States Patent [19]

Hartman et al.

[11] Patent Number: 4,909,648

[45] Date of Patent: Mar. 20, 1990

[54] PROCESSOR FOR FORMS WITH MULTI-FORMAT DATA

[75] Inventors: G. William Hartman, Longwood; Robert L. Wohlers, Leesburg; Thomas R. Routhieaux, Longwood, all of Fla.

[73] Assignee: Datamax Corporation, Orlando, Fla.

[21] Appl. No.: 233,804

[22] Filed: Aug. 18, 1988

Related U.S. Application Data

[62] Division of Ser. No. 146,210, Jan. 20, 1988.

[51] Int. Cl.[4] ..... B41J 33/546

[52] U.S. Cl. ..... 400/234; 400/225; 400/232; 400/219.1

[58] Field of Search ..... 400/219, 225, 232, 219.1, 400/218, 232, 234

[56] References Cited

U.S. PATENT DOCUMENTS

| | | | |
|---|---|---|---|
| 3,855,457 | 12/1974 | Amundson et al. | 101/69 |
| 4,264,224 | 4/1981 | Mathews | 400/234 |
| 4,294,552 | 10/1981 | Mako | 400/234 |
| 4,378,566 | 3/1987 | Tsukamura | 400/234 |
| 4,475,829 | 10/1984 | Goff, Jr. et al. | 400/225 |
| 4,619,197 | 10/1986 | Pailler | 400/621 |
| 4,640,635 | 2/1987 | Nakai et al. | 400/225 |
| 4,710,044 | 12/1987 | Ackermann | 400/219.1 |
| 4,747,716 | 5/1988 | van der Eikel | 400/234 |
| 4,793,723 | 12/1988 | Furhata | 400/234 |

FOREIGN PATENT DOCUMENTS

| | | | |
|---|---|---|---|
| 234254 | 9/1987 | European Pat. Off. | 400/219.1 |
| 2445260 | 4/1976 | Fed. Rep. of Germany | 400/219.1 |

*Primary Examiner*—William Pieprz

*Attorney, Agent, or Firm*—Steele, Gould & Fried

[57] ABSTRACT

A multi-format document printer and processor has a plurality of data writing and reading means for data in different formats, disposed along a transport path. Forms are separated from a continuous perforated form supply and advanced along the transport path. Bidirectional drive rollers disposed along the path advance the documents and reverse them for reprocessing as necessary. At the end of the transport path, the documents are routed to an exit hopper or a reject hopper and a sensor at the exit detects already-issued forms manually loaded by an operator, which already-issued forms can be likewise bidirectionally processed for reading, verification, modification and the like. The processor is preferably embodied for transportation tickets and boarding passes, having: optical character recognition (OCR) write and read devices, magnetic strip write and read devices and a dot matrix printer having an array of print heads operable to print a document in one pass. Reversible feed and take-up spools for a wide ribbon movably disposed under the dot matrix array are provided with separate bidirectional two-speed drives. Movable tension arms along the ribbon path detect a near-empty condition of either of the spools by timing the rate at which the tension arms are deflected with the spools operating at different speeds.

4 Claims, 4 Drawing Sheets

PROCESSOR FOR FORMS WITH MULTI-FORMAT DATA

This is a division of application Ser. No. 146,210 filed Jan. 20, 1988.

BACKGROUND OF THE INVENTION

1. Field of the Invention

This invention relates to the field of document processors for writing data to a document and reading data therefrom. The invention is especially useful as to an airline ticket and boarding pass printer and processor generally operable for issue of tickets and boarding passes and for receiving already-issued tickets and boarding passes for reading and verification, modification or reissue.

2. Prior Art

A wide variety of devices are known for producing a visually perceptible record in the form of printed characters or symbols. In addition to printing devices operable to print a visually-perceptible record on a document, the prior art includes special purpose printers operable to write corresponding records in a plurality of formats on a document, each format being intended for later use by specific document processing machines responsive to the particular formats used. In connection with ticket and boarding pass printers, and especially those used internationally, processing machines including optical character recognition devices (based upon strictly standardized character shapes), magnetic ink and/or magnetic strip reading and writing devices are known. It is usually necessary to have some visually perceptible data appear on the document for verification and sorting by humans. Disclosures particularly relating to tickets used for transportation can be found, for example, in U.S. Pats. Nos. 4,240,862 - Ishiyama and 4,381,705 - Roes, et al.

Specific ticket handling mechanisms are used in connection with airline ticket and boarding pass printers and also in connection with railway tickets. Railway tickets can be issued to riders with a certain number of rides or a certain sum of money encoded on the tickets as having been paid. The sum can be stored as a binary digital record on a magnetic strip and corresponding data is printed on the ticket such that the user can determine the current sum available. When the user presents the ticket in payment for a ride or like service, the recorded sum is read, reduced and written back to the ticket. By including more than one format, data is made available for use by machines and by humans, in a state most conveniently processed by them. Examples of multi-format tickets are found in Pats. Nos. 3,641,931 —Hickox, et al; 4,040,345 —Adams, et al; and, 4,196,665 —Rogers, et al.

The need to process documents with multiple formats presents a challenge to the designer. Each format requires its own structure adapted for reading and writing apparatus associated therewith. These structures could routinely be laid out one after another, however, this multiplies the size and complexity of a device. Furthermore, record processing requirements can be inconsistent. Some formats (e.g., magnetic strip) require a continuous motion of the form while writing or reading. Other record processing steps (e.g., character printing with impact heads) are more difficult if the documents are allowed to move continuously relative to the processing apparatus. A typical approach to the problem of inconsistent requirements for the various different formats according to the prior art has been to use separated forms and to dispose each of the separate format processors at a different and distinct point along a transport path, sufficiently remote for different document handling parameters at separate areas along an elongated processing path. The result is a device which is relatively large, and characterized by complex feed characteristics.

FEATURES OF THE INVENTION

According to the present invention, a fully controllable bidirectional document feeding system is provided along a short processing path wherein the means for processing distinct formats at least partly overlap. Forms fed from a supply of continuously-connected forms are separated initially and processed bidirectionally. Preferably, the processing includes optical character recognition (OCR) encoding and reading, magnetic format encoding and reading by magnetic strip or magnetic ink characters, and, as a final step, dot matrix printing of a user-readable visual record that corresponds in whole or part to the information encoded otherwise. The forms processed are also readable and sortable. As a result of the bidirectional feed, it is possible to not only issue forms, but to re-process already-issued forms which can be manually loaded at the outlet of the processor, read and processed, using the same apparatus and many of the same techniques used for newly issued forms.

Another demand presented by multi-format processors and printers relates to the time spent in processing. In connection with document processors and ticket processors in particular, time is of the essence. Therefore, elongated, time consuming, transport paths and step by step reading/writing procedures are not well suited. Therefore, many design improvements that might be appropriate in order to improve the quality of print, especially with respect to visually perceptible data, cannot reasonably be employed in these devices. Where the data to be written on the documents is extensive, e.g., more than a single line such as a current balance on a subway ticket, etc, the print head requirements and document feeding requirements can be severe. Many printer features for reducing hardware or control requirements, such as movable print heads, line-by-line printing and reading and the like, simply take up too much time. According to the present invention, forms are fed through an OCR station and a magnetic strip station that actually overlap. A shaft encoder associated with a pinch roller is applied to the forms such that constant speed or a single direction of motion is not needed for all steps of processing of the document. The document can be reversed during processing and/or accelerated and decelerated, without disruption of processing. The outlet of the encoder is likewise used to trigger specific character-generation means which, as noted above, are staggered along the transport path.

The document printer and processor of the invention is useful for a number of multi-format processing functions that otherwise would require issue of a new ticket. While the invention is intended to process and issue documents such as tickets from a supply of blank forms, the invention is likewise fully useful to read already-issued tickets individually or in batches, and to verify, modify and/or reissue tickets as required subject to processor control. Originally issued tickets are fed from a supply of continuously-connected tickets, separated at an early processing step, and then processed through writing and accuracy-verifying read steps. At the end of the transport path, a dot matrix bulk printer is disposed for human readable data, e.g., a visual record of the machine-readable data, verification indicating marks, cancellations and re-written indicia.

According to the invention, procedures for reading after writing to verify correct writing, can be used to enter data into a system apart from writing data upon issue of new documents, provided previously-issued documents can be conveniently loaded into the document processor and routed to the appropriate part of the transport path. The present invention has a bin at an output of the transport path for receipt of finished process documents, a reject bin at the output for accumulating documents which were not processed correctly or have been cancelled, and means at the output for accepting documents, that are fed counter to the feed direction for new forms, for re-processing. An exit sensor detects the document to be re-processed and the transport routes re-loaded documents from the outlet backwards to an intermediate point at which read operations and any needed re-write operations are undertaken.

In the preferred embodiment, a plurality of separate processors control the various functions of the device. A supervisory processor communicates with one or more outside computers, whereby the invention is operable as a peripheral device on a data processing system or network. A separate processor is preferably provided to control transport functions. The reading and writing means for the magnetic strip data and for the OCR data are likewise controlled through separate processors, and a keyboard can be provided directly on the document processor, controlled by yet another processor.

The invention represents an optimal application of multi-format reading and writing devices to the problems associated with uses such as processing of airline tickets and boarding passes. The layout of parts and their specific control and operation are adapted for fast and accurate processing of tickets according to a large number of separate requirements for processing individually or in batches, issuing or reading forms, modifying forms to accommodate changes in travel plans and other functions.

SUMMARY OF THE INVENTION

It is an object of the invention to provide a high speed high accurate processor for documents having means for receiving and indicating information in a plurality of formats.

It is another object of the invention to provide an airline ticket and boarding pass printer that encodes, verifies, reads and modifies data written to or read from documents originally issued as tickets and boarding passes, or re-entered into the system after their original issue.

It is another object of the invention to minimize the size of a multi-format document processor, especially the length of transport of the document along a path from supply to exit.

It is further object of the invention to minimize the time of processing of documents by optimal bidirectional processing of documents on a transport path along which multiple format writing and reading means are disposed.

It is a further object of the invention to provide a document processor having a plurality of distinct stock inputs adapted fro handling variations on the documents and on the processes applied thereto.

It is a further object of the invention to optimally apply a dot matrix bulk data printer to a multi-format document processing system by providing in a multi-format system a one pass matrix printer having an array of print heads and a ribbon feeding and driving means specifically applicable to the print head array.

These and other objects are accomplished by a multi-format document printer and processor with a plurality of data writing and reading means for data in different formats, disposed along a transport path. Forms are separated from a continuous perforated form supply by means at an inlet to the device and advanced along the transport path. Bidirectional drive rollers disposed along the path advance the documents and reverse them for reprocessing as necessary, with the document's current position being sensed and monitored using a shaft encoder on a pinch roller and sensors positioned along the transport. At the end of the transport path, the documents are routed alternatively to an exit hopper or reject hopper using a diverter mechanism. A sensor at the exit detects re-entry of previously-issued forms manually loaded by an operator. Previously-issued forms are brought back along the path and bidirectionally processed for reading, verification, modification and the like. The processor is preferably embodied for transportation tickets such as airline ticket and boarding passes, having optical character recognition (OCR) write and read devices, magnetic strip write and read devices and a dot matrix printer having an array of print heads operable with a wide ribbon to print a document in one pass. Reversible feed and take-up spools for the wide ribbon movably disposed under the dot matrix array are provided with separate bidirectional two-speed drives. By timing the displacement of movable tension arms the transport processor detects a near-empty condition of either of the spools for reversing the ribbon when time is available.

BRIEF DESCRIPTION OF THE DRAWINGS

There are shown in the drawings the embodiments that are presently preferred. It should be understood, however, that the invention is not limited to the precise arrangements and instrumentalities shown in the drawings, wherein.

DETAILED DESCRIPTION OF THE PREFERRED EMBODIMENTS

Figure 1:
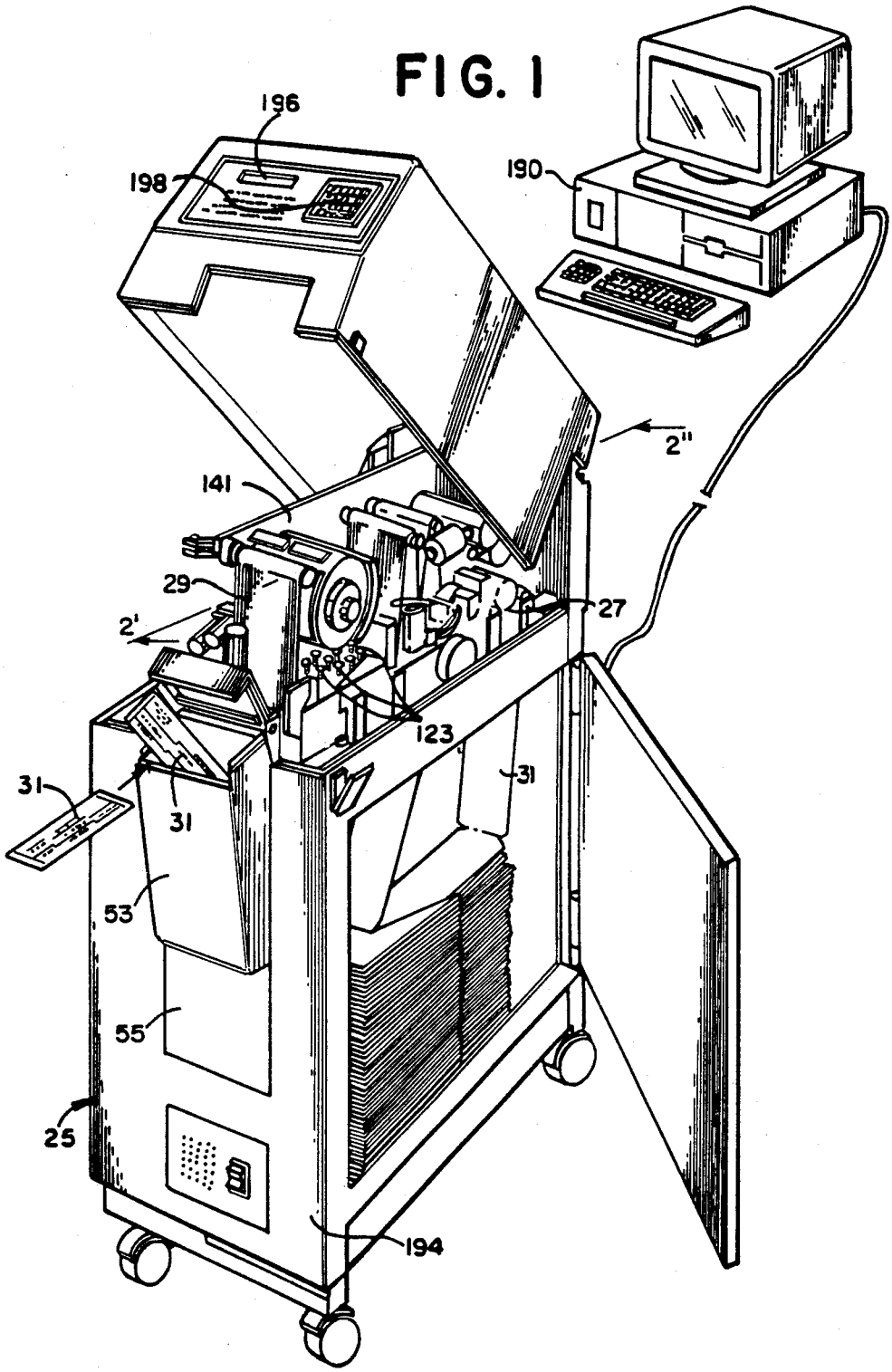
FIG. 1 is a perspective view of the processor for forms with multi-format data according to the invention, shown opened.

Printer unit 25 as shown in FIG. 1 is preferably a compact mobile unit in a cabinet having a lower storage bin for fan-fold serially-attached documents 31 in two supply stacks, the forms 31 from each stack being fed upwardly along a transport path 27 leading from the rear of the unit to the front, where the forms are ejected or stored in a storage bin. Means for reading and writing indicia on the forms 31 are disposed along transport path 27. The housing for the power supplies, circuit cards and the like required to operate and control the unit are disposed on an opposite side (not shown) from bin storage 31, being likewise accessible by opening a side panel. The device is connected by means of hard wiring, phone lines or other data communication techniques, with one or more computers 190, which are used to enter data to be printed, to effect control of the printer and generally to manage the overall document issuing and processing system. In the preferred embodiment the documents are airline tickets and/or boarding passes, although other document types can also be processed with a unit as disclosed.

In FIG. 1, the side panel and also top cover are shown pivoted away from the transport path area. The transport path is shown in side elevation in FIG. 2. Referring to FIG. 1, the top cover includes a display 196 and an optional keyboard 198 for direct entry of data as needed for test and diagnostic purposes. Display 196 can include visual displays such as alarm status lights for alerting the operator to jamming, low paper conditions and other situations requiring an operator's attention. The unit 25 can be mounted on casters and moved around as convenient. It is intended that document printer/processors according to the invention can be usefully employed at the offices of agents responsible for issuing and processing tickets, at transportation system gates and transportation system sales counters where users can check in and/or change their arrangements, or at other convenient locations. Programming for each location can be specific to that location, with the various processors 190 communicating with one another as required to ensure that the different printers operate consistently with respect to the issue of tickets and the like.

Although the invention is described with respect to a ticket printer and specifically with respect to an airline ticket and boarding pass printer and processor, it will be appreciated that the device is generally applicable to any situation in which documents are to be issued and, when desired, re-entered into the system for further processing, namely reading, verification and/or modification and re-issue. Document issue and re-processing uses are not limited to airline tickets and passes or even to transportation, but also may be employed as labels for merchandise and inventory control systems, identification means and other uses.

Figure 4:
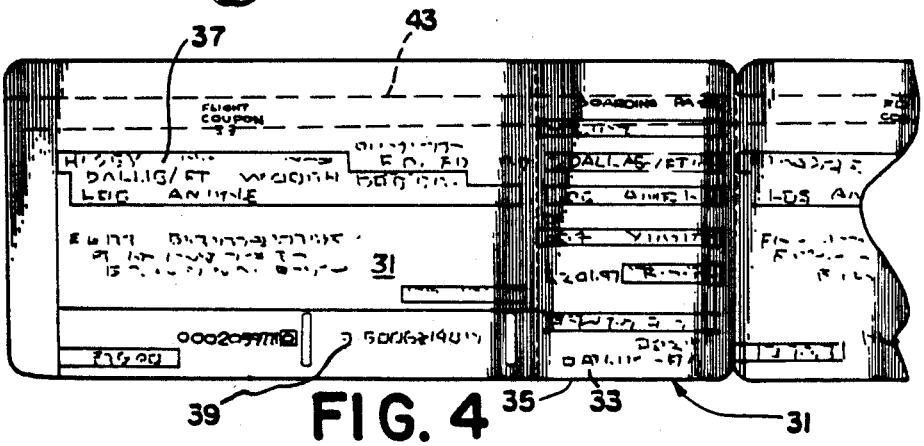
FIG. 4 is a plan view of a document processed according to the invention.
Figure 5:
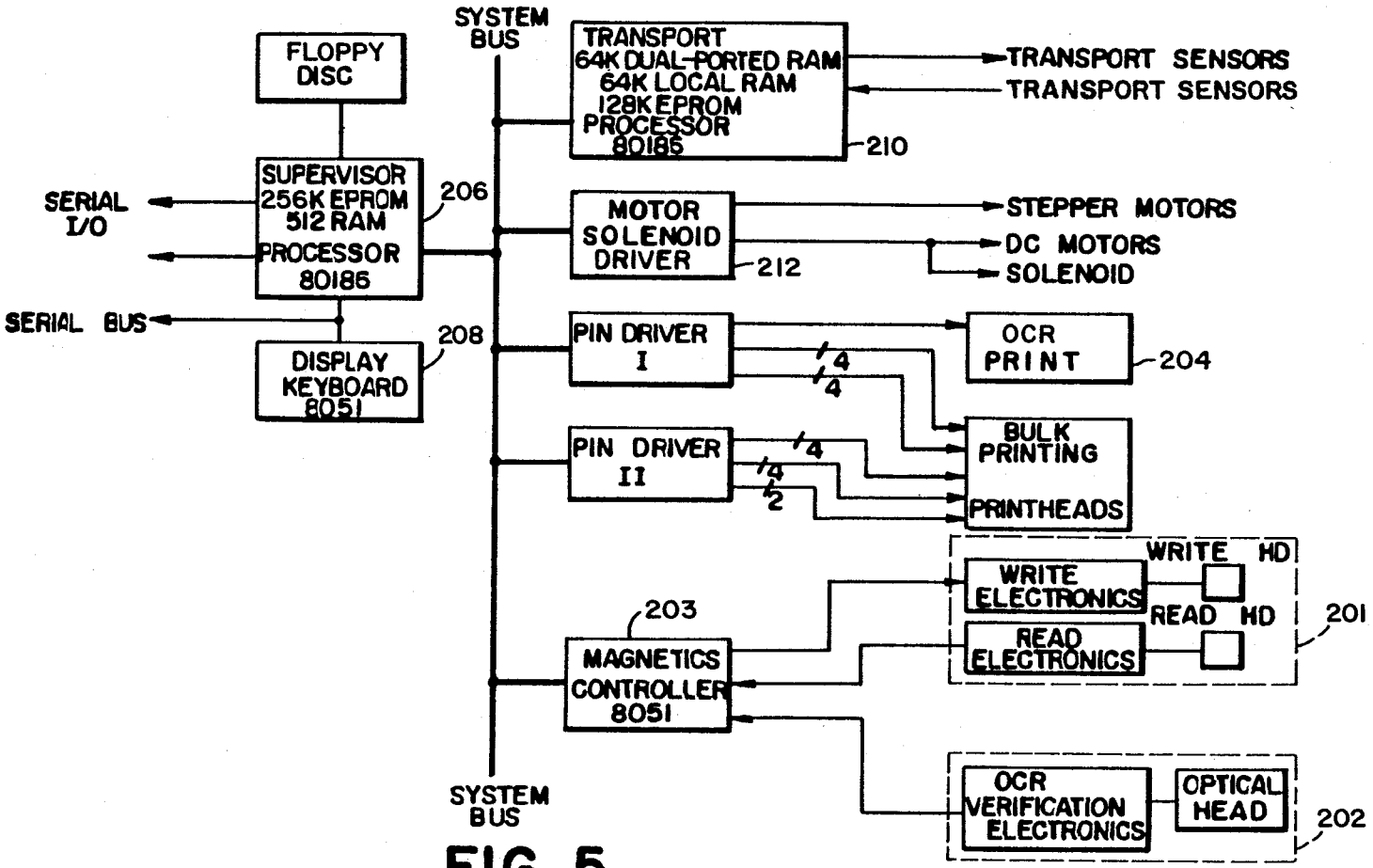
FIG. 5 is a block diagram of the processor hierarchy according to the invention.

According to the preferred embodiment involving airline ticket and boarding pass printing and processing, tickets 31 as shown in FIG. 4 have a stub 33 attached to ticket 31 along a perforation, and may have a boarding pass section 35 (as part of stub 33) removably attached along a perforation. A magnetic strip area 43, disposed on one side of the card, receives magnetically-encodable data. An optical character recognition (OCR) character section 39 is provided, for example to permit unique association of the individual form to a serial number of similar reference indicia. Finally, a bulk printing area 37, for example an area for receiving characters printed by dot matrix techniques, allows the user or others to visually determine the data present on the document. Of course the visually-printed data can correspond wholly or only in part to the encoded data.

The device of the invention is not applicable only to issue new tickets from storage stocks 31, but also will accept the input of already-printed tickets for reprocessing. Tickets for reprocessing can be the same ones issued from the subject device, a similar other device, or a dissimilar device having at least one data format that can be read or written by the subject device. The tickets 31, as shown in FIG. 1, are either removed from or entered into the device through the front port of processing unit 25. The tickets, whether entered through the front port or via ticket storage stocks 31, move bidirectionally along transport path 27, through the specific reading and writing devices located thereon. As embodied for simply producing tickets, the processor is adapted to produce any number of tickets and to load them into output hopper 53 on the front of device 25. Should any of the processed tickets be cancelled or found to unreadable, they can be stored in a reject hopper 55. The output and reject hoppers are provided with hopper full sensors, used to activate alarms or to disable further operations in order to prevent a jam.

Figure 2:
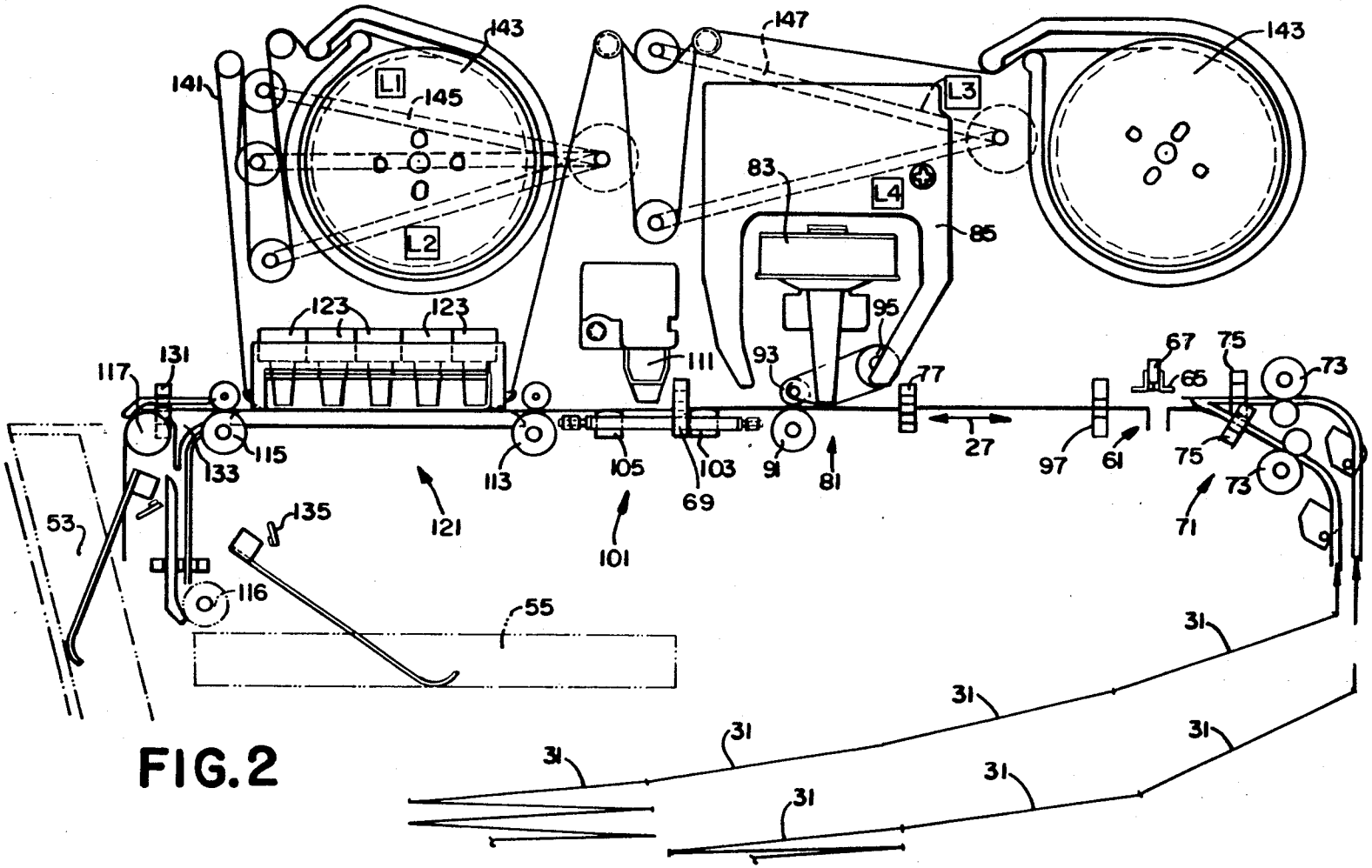
FIG. 2 is a schematic section view generally from the perspective of section line 2'-2" in FIG. 1.
Figure 3:
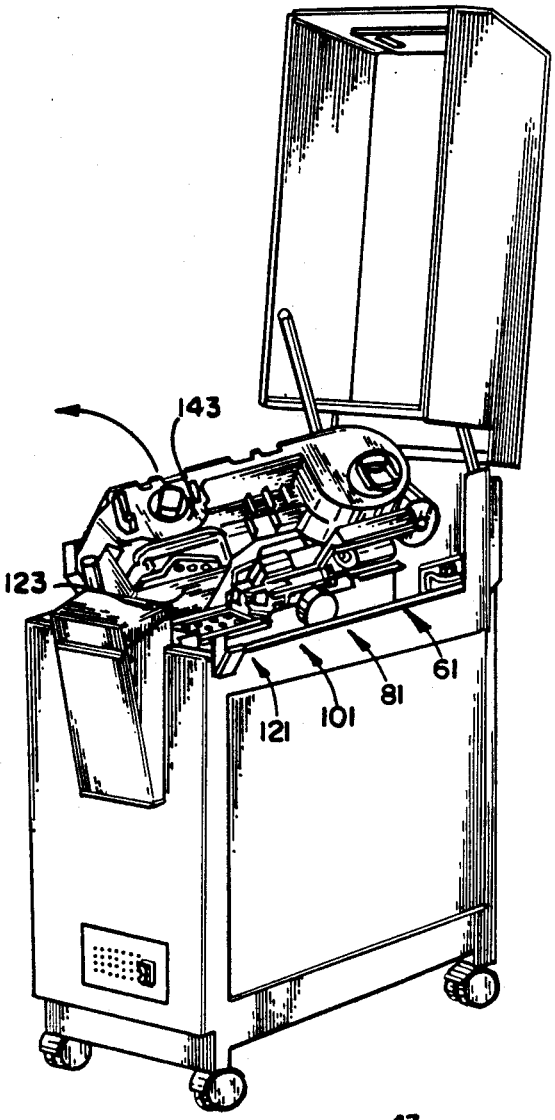
FIG. 3 is a perspective view of the device with its upper frame raised to expose the transport path.

FIG. 2 is a partial side section showing the operative elements along transport path 27. The stations along the path include the dual feeding section 71, the burster section 61 for separating individual forms 31 from the fanfold supply thereof, an optical character recognition printer and reader at OCR station 81, a magnetic reader and sensor at magnetic processing section 101, and a bulk printing section 121 immediately preceding the output. Pinch rollers are disposed in pairs spaced locations along transport path 27, and are used to drive the forms back and forth. At least certain ones of these roller pairs are bidirectionally driven, permitting reprocessing of forms loaded at the outlet through outlet pinch rollers 115.

At the inlet for new forms 31 from the dual supplies, pinch roller pairs 73 are provided for each of the separate tracks, these rollers being adapted to drive the forms forward in a continuous connected strip. Sensors upstream of rollers 73 along the path 27 provide signals with respect to the presence or absence of stock. When stock is present and one of the dual drives is activated, the next document (e.g., ticket or other form) is advanced first to one of two sensors 75 operable to detect the front edge of the form. Upon commencing processing of the form, the front edge is advanced using driver rollers 73 to transport sensors 69, whereupon the perforation between tickets is positioned at burster station 61.

Burster station 61 has a burster blade structure comprising a stripper 65 and blade 67. The blade 67 and stripper 65 are resiliently mounted with respect to one another such that as the blade comes down, stripper 65 first contacts and locks the form 31 against the adjacent surface along transport path 27. With continued downward advance, blade 67 comes down between the sides of stripper 65 to break the perforation between the tickets. The foremost ticket is then ready for processing, being separated from the stack. In order to neatly break the connected forms at their perforations, the perforation lines are cut through for a length extending transversely inward on opposite edges of the card, e.g. by 2 cm or so.

After the supply has been perforated and a ticket separated from the remaining stock, the next form in line for the burster can be retracted immediately via pinch rollers 73 such that the path is cleared should the next ticket be supplied from the alternate stock. It has been determined that, as a practical matter, a number of tickets usually will be fed from one supply or the other before changing to the other supply. Therefore, the invention is preferably embodied such that the next ticket in line is not retracted in the usual case and instead remains positioned adjacent the burster as the previous now-separated ticket is processed. The next ticket is only retracted in the event that a next command from computer 190 or the like is for a ticket from the alternate supply. Therefore, pinch rollers 73 need not retract the forms in the usual course, reducing typical processing time.

Transport sensors 77 and 97 detect the presence of a ticket downstream drive rollers 73 and the remainder of the processing apparatus downstream along the path of transport (right to left for new tickets in FIG. 2). Sensors 75 detect tickets near rollers 73. A burst edge sensor 75 and write edge sensor 97 disposed upstream of transport edge sensor 77 activate the burster station 61. Having been separated from the supply, the form is ready for application of OCR characters at OCR station 81. A packaged OCR print head 83 is provided immediately downstream of transport sensor 77, being operable to print OCR characters, namely characters having very specific defined shapes, on the form passing underneath OCR write head 83. Write head 83 is associated with a ribbon cartridge 85 as a compact unit. A pinch roller pair 91, 93, the latter being movably controlled by a pinch roller solenoid 95, are operative to engage and move form 31 to print the OCR characters. A shaft encoder operative to produce a plurality of digital pulses during a revolution of roller 91 is associated with pinch roller pair 91, 93, and is thereafter used in conjunction with an up/down counter (not shown) to determine the precise position of the form 31 along the transport path 27. The starting position is known when the write edge sensor 97 operates (a trailing edge of the card being at the predetermined position of write edge sensor 97 when the form 31 is positioned to begin OCR printing and magnetic encoding). When the form 31 is thereafter advanced, pulses from the shaft encoder connected to pinch roller 91 accurately track the advance of the form.

The shaft encoder associated with roller 91 allows processing of the document to proceed independent of timing and instead being dependent upon the position of the form along transport path 27. Using the output pulses of the shaft encoder to indicate advance of the form, magnetic write heads 103 and read heads 105 write and read, respectively, data on the magnetic strip on one side of form 31 at predetermined areas along the form. At approximately the same location as the edge sensor 69, and magnetic heads 103, 105, OCR read head 111 reads and verifies the characters printed by OCR write head 83 through ribbon 85, these operations continuing substantially concurrently as the form 31 advances along the transport path. Accordingly, the OCR and magnetic information are each read and verified after being written, with the form advancing from right to left in FIG. 2.

The foregoing processing of machine-readable information is conducted and completed while the greater portion of the document travels through the bulk printing station 121, which is spaced from the other data reading and writing heads by less than one half the length of a form 31. Therefore, it is possible to write OCR and/or magnetic data, and to read and verify it before initiating a bulk print operation. Should the data be read and verified as accurate, the form is reversed to the transport sensor 77, stopped and then advanced for printing information to be read by humans, using bulk printing station 121. The human readable information can indicate, in part, the accuracy of the machine readable data. Should an error be detected, the form can be reversed driven backward to write edge sensor 97 using rolls 113, 91, 93, to be reprocessed. As required by the user, attempts to reprint and reverify the accuracy of printed information can be conducted for one or more tries. Alternatively, the read sensors for the magnetic strip and the OCR characters can be used as pass/fail indicators, and any improperly printed or encoded document can be simply discarded into reject hopper 55.

Bulk printing station 121 includes a plurality of print heads 123 mounted in a staggered array on a plate positioned over transport path 27. Print heads 123 are preferably packaged dot matrix print heads, mounted in a staggered array such that each line of print across the width of the transport path has a single print head 123 operable to print that line. Inasmuch as print heads 123 are staggered, they vary in their relative positions along the transport path. Therefore, timing is required in order to delay printing for the more-downstream heads such that the printed text lines up vertically on the form with characters printed by the more-upstream or more downstream of the heads. This function is facilitated by driving the print heads using the up/down counter that reflects the current position of the form, which up/down counter is connected to the output of the shaft encoder responsive to pinch rollers 91, 93, 113, 115. By using the shaft encoder the printing is independent of time and is instead dependent upon form position along transport path 27. Data to be printed at bulk print station 121 can be loaded into a buffer memory, the contents of which are advanced through the memory and, using a read only memory or the like whose addressing is arithmetically modified to correct for the lag in form position that is caused by the staggered print heads. The appropriate pins of print heads 123 are operated when the form 31 passes the appropriate position to place the printed characters in the needed pattern.

Downstream of bulk printing station 121, an exit section is provided with means responsive to the transport processor to control whether the forms are routed to the output bin 53 or to the reject hopper 55. A diverter 133 having a displaceable picker mounted on a pivotal section, can be rotated slightly counter clockwise such that the picker reaches over and catches the leading edge of an oncoming form 31, diverting the form downwardly into reject hopper 55. Likewise, the diverter 133 can be left in its clockwise-rotated position, allowing the form 31 to advance to the point of exit sensor 131. At this point, a roller 117 at the extreme output along transport path 27 can be operated to move form 31 into the output hopper. Similarly, a user who wishes to load an already-printed form into the printer to be read, verified or otherwise re-processed, simply places the form against the output roller 117 and presses it inwardly to block the path across exit sensor 131. In this case, the apparatus is triggered to accept a form for re-processing, advancing the form backward along transport path 27 to the read and write sensors associated with OCR station 81 and magnetic section 101.

Inasmuch as an array of dot matrix print heads 123 is provided across the transverse width of the advancing forms, a very-wide ribbon is necessary in order to accommodate all the heads. Preferably, eighteen heads are provided in an array staggered in three or more rows such that eighteen lines are printable across the form. A protective shield plate is disposed under the ribbon and over the form 31 along transport path 27 such that the ribbon cannot generally contact and smudge form 31 in printing. Only football-shaped openings in the shield between the print heads 123 and the ribbon are provided for access of the contact members of heads 123, for example a plurality of wire pins separately controllable for advance against the ribbon, as necessary to define alphanumeric characters from a pattern of dots or other marks on form 31.

The roller pairs 73, 91/93, 113 and 115 can be provided with separate motors, for example stepping motors, driven by the transport processor. Preferably, roller pair 73 employes two motors while pairs 91/93, 113 and 115 each employ one motor and one idler roller. Each of the motors is bidirectional, upon control of a processor supervising the transport of forms 31 along path 27. Each of the ribbon spools is also provided with a separate reversible motor, however, accurate positioning using the ribbon motors is not a problem and motors other than steppers are appropriate.

Ribbon spools 143 can be mounted in a cartridge or can be separately mounted. In either event, one of the spools 143 at any given time functions as a feed spool and the other functions as a take-up spool. When the supply on the feed spool is nearly exhausted, the ribbon is reversed and the supply and take-up functions are reversed.

The two spools 143 have separate drive motors and each of the separate drive motors is controllably drivable at either a low speed or a high speed. The transport processor, in connection with changing the drive speeds of the ribbon spools, employs tension arms 145, 147, the position of which varies regularly during advance of the ribbon due to differences between the supply and take-up spool rotational speeds (i.e., as a result of driving the take up slower than the supply or vice versa), and also due to the difference in circumference between a full spool and an empty spool, which varies as the supply is exhausted.

Assuming that one of the spools (Spool A) is the feed spool and the other (Spool B) is the take-up spool, one revolution of a full spool A may translate into almost two revolutions of spool B. The take-up spool B will operate at two speeds: a regular take-up speed and a faster take-up speed when the take-up spool is in its most empty condition. The feed spool A will also operate at two speeds. First, it will rotate in a high speed feed mode which will always supply more ribbon than take-up spool A can accept, regardless of its speed or of the spool diameters. The second feed roll speed is so slow that it will supply ribbon so slowly that the take-up spool A will always want more, regardless of its take-up speed or the spool diameters. The choice of speeds of the ribbon motors is determined by the transport microprocessor by timing the motion of the tension arm 147 or 145 which is associated with the feed spool B.

The feed spool B tension arm serves a dual purpose. First it moves up and down between its two limit sensing switches L1, L2, L3, L4 to provide information to the transport microprocessor so the microprocessor can select the direction of ribbon rotation as well as the correct speeds for both the take-up and feed spools. The second purpose of the tension arm is to regulate and maintain a constant ribbon tension at all times during speed changes, reversals, etc. When the ribbon activity is begun, the take-up spool B is started and its speed is determined (regular or faster, if the spool is small). The feed spool A is activated at its higher speed. This will put more ribbon into the system than take-up spool B can accept so the tension arm 145 or 147 associated with feed spool A will drop to accumulate the extra ribbon. When the arm drops far enough to be sensed in its lowest position, feed spool A is switched to its slower speed which puts less ribbon into the system than take-up spool B wants. In this condition then, the feed spool tension arm will rise which provides more ribbon to take-up spool B. When the arm rises far enough to be sensed in its highest position, feed spool A is returned to its higher speed and the cycle begins anew.

Reversal occurs periodically, however, the precise time it takes the tension arm to deflect from its highest to lowest positions is related to the ratio of circumferences of the spools. Therefore, this time is a direct indication of the extent of ribbon remaining on the supply spool in the given winding direction. When the time needed to go back and forth between deflections indicates that the supply spool is nearly empty, the transport processor preferably reverses the direction of reeling and unreeling. This change in direction can be delayed to occur only at a moment when the bulk printer station 121 is inoperative. Accordingly, any print quality degradation of the forms 31 is avoided.

The means for sensing the position of the tension arms is preferably a projection of the arm that interacts with a sensor located to intercept the projection at a full deflection. An optical or magnetic sensor can be used for this purpose. The sensor need only be an on/off sort of indicator as the tension arm is not used for a control of itself but rather functions only as a moving element, the time for full transit of which being related to the instantaneous ratio of spool diameters.

In actual use, travel agents and the like having printers according to the invention can issue new tickets and boarding passes, these transactions being verified with the carriers by communication over phone lines with central processing networks. The issued tickets have variable multi-format information encoded and printed thereon, such as the travelers identify, various flight information, times, etc. A passenger with such an issued ticket arrives at the airport or other point of departure, whereupon the ticket is read in a device according to the invention to record in the processing system the fact that the customer has arrived and has passed that station (e.g., is ready for departure). Should the customer change his plans, the issued ticket can be re-processed and a new set of information inserted on the magnetic strip and, preferably, in the bulk printing zone, indicating the new arrangements. When the user eventually boards the carrier, the boarding pass section can be removed and processed to encode the customer's departure. At each of the issuing and processing locations, a device according to the invention is available to read, write, verify and otherwise process customer documents. These documents can be handled individually, in batches, or as a result of re-processing of previously issued documents.

A supervisory processor preferably communicates with external devices such as computer system 190, over standard interfaces according to an RS232, or a current loop interface. RS422 is likewise applicable. Although the device will also operate in a stand-alone mode, this mode is suited primarily for testing purposes rather than for regular use due to the requirement of data entry on the keyboard.

Bulk printing station 121 allows the forms to be printed in one pass. This station is preferably designed with the lines to be printed being as close together as possible, spaced for example at six lines per inch. It is necessary to stagger the print heads such that the rear housings closely abut and the print areas are spaced from one another in the direction of transport. Print heads are available with a plurality of wire pins directed toward the item to be printed, with solenoid drivers located in a rear housing part. The rear housing part of each head 123 is much wider than the space occupied by the print head on the line. Accordingly, staggering allows the print areas serviced by the print heads to be immediately adjacent one another although they are spaced along the transport path. Furthermore, the individual heads are replaceable in the event of failure, without the need to install a whole new print station configuration. There is no need to move or adjust the position of heads 123, the heads being rigidly mounted in a plate disposed over the transport path 27.

The process for handling documents according to the invention includes the steps of selecting documents from one of two sources, advancing the documents in fan folded perforated configuration to a sensor, and bursting the rear perforation. Preferably, the documents are attached to one another along perforations that are deep cut inwardly from the edges such that the operation of the burster does not strictly cut the perforations, but instead causes the perforations to separate cleanly. The burster is operable when the leading edge of the document reaches a sensor at a predetermined location, namely, one document length past the burster. During an initial pass of the now-separated ticket, the OCR characters and magnetic strip characters are written and then read for verification of accuracy. The documents are preferably reversed for a second pass. Assuming accuracy during the first pass, the form is advanced to the point of bulk print at station 121, where visually readable information is imprinted by means of dot matrix print heads 123. This bidirectional processing, by virtue of the transport processor controllably operating the driven rollers 115, 113, allowing the form to be reversed and re-read, bidirectional processing allows an already-issued form to be reloaded from the outlet. Not only can the device recover from an error, but the processor is made into an entire reading and writing form processor and not merely a printer. Furthermore, bidirectional feed allows the stations to be mounted closely, resulting in a much shorter overall transport path and more compact device.

A number of the multi-format options provided in the preferred embodiment are not strictly necessary but are useful in certain instances. For example a given user may not require processing with OCR characters. A given user might likewise be satisfied with separately-spooled ribbons rather than a ribbon cartridge. While the multi-formatting use of all the disclosed formats and procedures is recommended, the invention is likewise applicable to configurations that are not fully endowed.

The shaft encoder or tachometer operatively associated with roller 91, 93, 117 has a number of beneficial results. In additional to given incremental advance of a form 31 between the rollers. According to the preferred embodiment, shaft encoder pulses are provided at 840 pulses to the inch of linear advance of form 31 (331 per cm). In order to keep the advance of the form 31 synchronized with rotation of the shaft encoder, pinch roller solenoid 95 and pinch roller 93 are controllably operable to bear downwardly against form 31 when the form is in the area of the shaft encoder. During different functions, it is possible to vary the speed and length of advance. For example, when a ticket is being reversed along transport path 27, the drive can be operated at full speed. However, for OCR printing or the like, the form is preferably advanced more slowly during the actual print impact. The bulk printing station 121 can be operated while the form is advancing at speeds from slow to full speed depending on the density (frequency or dots) of what is being printed (i.e., 10 or 17 characters per inch).

The physical mounting of the portions of the apparatus over and under the form 31 moving along the transport path is arranged such that all portions of the device disposed above the transport path are mounted on a common frame plate that can be hingeably rotated upwardly away from the form transport area, for cleaning or other maintenance. Accordingly, the bulk printing heads and the ribbon mechanism, are all mounted on the separate frame plate, hingeably mounted along an edge of the lower table member defining the transport path. The OCR read/write section is mounted to a second frame plate hinged along the other edge of the lower table member. Both upper frames thus can be pivoted along an axis parallel to the transport path, and rotated away from the transport path for cleaning, maintenance and ribbon loading. Preferably, the upper frame and lower table are attachable together by means of bail clips at the opposite side of the transport path from the hinge axis, whereby the upper frame plates are rigidly lockable in operative position when closed.

As noted hereinabove, the preferred embodiment of the invention employs a plurality of processors for different functions. The magnetic strip reading and writing mechanisms and the OCR reading and writing mechanisms are packaged units and employ their own processors. Apart from processors (unit 203) devoted to the magnetic strip (201) and OCR character reading (202) and writing (204), respectively, a supervisory processor (in unit 206) is provided to oversee operation, to communicate with outside processors and to transmit data bidirectionally between said processor and the remaining processors. A keyboard processor 208 is provided to supervise the keyboard, control displays and the like. A transport 210 processor responds to the sensors along the transport path and controls operation of the motor drives (212), ribbon motors, burster, printheads (via Pin Driver I and III), and other movable elements associated with the device. Preferably, the supervisory processor is a model 80186 microprocessor as marketed by Intel. Programming for the supervisory and transport processors are preferably provided on EPROM, about 256K bytes being required for programming. Random access memory is also required, depending on the extent of information to be stored, preferably about 0.5M byte for storage of both current and historical information to be downloaded to remote computer when time is available.

The transport processor includes timing and drivers operable to drive the individual pins on the print heads 123. Operation of the pin drivers depends upon ROM character dot mapping, triggering as generated by the shaft encoder (transport sensors) to reflect the position of the document and the position of the respective print head from the other print heads. Preferably, a programmable arithmetic logic (PAL) unit is arranged such that a dump of character data from the supervisory processor to the transport processor results in properly timed execution of individual dots in the pin drives without specific intervention of the transport processor's microcomputer to arithmetically adjust operation of the pins to account for staggering of the print heads.

In general, the software needed to operate the supervisory and transport processors is a multi-tasking arrangement with pipelining such that different jobs are handled at different stages in processing and a number of jobs can be in progress at the same time. The tasks are prioritized such that those jobs requiring specific time operation, for example the operation of a particular pin drive, will occur when required.

The invention is capable of a number of other applications in addition to airline ticket and boarding pass printing and processing. A number of variations are also possible and will now be apparent to persons skilled in the art made aware of this disclosure. Reference should be made to the appended claims rather than the foregoing specification as indicating the true scope of the invention.

What is claimed is:

1. A multi-format document printer and processor, comprising:

at least one data processor for receiving data to be transferred to and from a plurality of successive forms;

means for feeding the forms along a transport path in either of two opposite directions, including a reversible drive for forms and at least one edge sensor;

write means operable responsive to the processor to print variable information on successive ones of said forms in a first format, the first format being a machine-readable format;

read means in communication with the at least one processor to read said variable information in said first format, the processor being operable to compare said variable information as read to variable information previously printed;

an impact printer having a plurality of print heads disposed downstream of the write means and the read means along the transport path, the printer producing a visually readable record on the successive forms;

a ribbon disposed between the print heads and the forms;

means for bidirectionally feeding the ribbon including ribbon spools disposed at two opposite ends of a ribbon path and individual drive means for each of the ribbon spools, the individual drive means each being operable in either of two opposite directions and at two distinct speeds in each direction;

ribbon tension control and sensing means operable to detect maximum and minimum amounts of excess ribbon between the ribbon spools and to change the speed of said ribbon spools based thereon, the ribbon tension control and sensing means being operable to detect near exhaustion of ribbon on one of the spools and to reverse the individual drive means, the ribbon tension control and sensing means having tension arms disposed between each of the spools and the print heads, and means for detecting full displacement of the tension arms, said near exhaustion of the ribbon being detected by variation in a time period for one of the tension arms to reach full displacement.

2. The multi-format document printer and processor of claim 1, wherein the impact printer is a dot matrix printer having a plurality of print heads disposed in a staggered array, the print heads each having a plurality of reciprocable contact members and means for advancing the contact members against the form to define characters on the form.

3. The multi-format document printer and processor of claim 1, wherein a ratio of slower speed and a faster speed of each said respective spool is such that ribbon moves smoothly with substantially constant tension regardless of spool circumference.

4. A document printer, comprising:

means for receiving data to be printed on a plurality of successive forms;

means for feeding the forms along a transport path;

write means operable responsive to said means for receiving data to print variable information on successive ones of said forms, by impact directed toward said forms through a ribbon, via an impact printer having a plurality of print heads producing a visually readable record on the successive forms;

means for bidirectionally feeding the ribbon, including ribbon spools disposed at two opposite ends of a ribbon path and individual drive means for each of the ribbon spools, the individual drive means each being operable in either of two opposite directions and at two distinct speeds in each direction;

ribbon tension control and sensing means operable to detect maximum and minimum amounts of excess ribbon between the ribbon spools and to change the speed of said ribbon spools based thereon, the ribbon tension control and sensing means being operable to detect near exhaustion of ribbon on one of the spools and to reverse the individual drive means, the ribbon tension control and sensing means having tension arms disposed between each of the spools and the print heads, and means for detecting full displacement of the tension arms, said near exhaustion of the ribbon being detected by variation in a time period for one of the tension arms to reach full displacement.

* * * * *